US006053818A

United States Patent [19]

McCormick

[11] Patent Number: 6,053,818

[45] Date of Patent: Apr. 25, 2000

[54] BILLIARD TABLE CORNER CONSTRUCTION

[75] Inventor: William R. McCormick, Kenosha, Wis.

[73] Assignee: Brunswick Bowling & Billiards Corporation, Muskegon, Mich.

[21] Appl. No.: 09/144,728

[22] Filed: Sep. 1, 1998

Related U.S. Application Data

[60] Provisional application No. 60/082,799, Apr. 23, 1998.

[51] Int. Cl.[7] ..... A63D 15/00; A47C 17/62

[52] U.S. Cl. ..... 473/4; 473/13; 473/31; 273/309

[58] Field of Search ..... 473/15, 22, 28–33; 108/115, 130, 131, 156, 157.1, 108–110; 248/188, 188.1, 188.8, 188.91, 188.4, 200, 205.4, 218.4, 220.1; 273/309

[56] References Cited

U.S. PATENT DOCUMENTS

| | | | |
|---|---|---|---|
| 159,390 | 2/1875 | Came | 473/13 |
| D. 332,293 | 1/1993 | Powers | D21/784 |
| D. 348,916 | 7/1994 | Powers | D21/784 |
| 736,938 | 8/1903 | Clark | 473/14 |
| 1,220,236 | 3/1917 | Kemp | 273/309 |
| 1,516,654 | 11/1924 | Treiber | 273/8 |
| 1,781,423 | 11/1930 | Wood | 473/31 |
| 2,371,329 | 3/1945 | Hirsch | 248/188.91 |
| 3,180,642 | 4/1965 | Reineman | 473/4 |
| 3,455,551 | 7/1969 | Untiedt | 473/22 |
| 3,458,193 | 7/1969 | Rockwood et al. | 473/22 |
| 3,497,048 | 2/1970 | Le Mieux et al. | 473/24 |

FOREIGN PATENT DOCUMENTS

| | | | |
|---|---|---|---|
| 7833 | 3/1907 | United Kingdom | 473/30 |

*Primary Examiner*—Jeanette Chapman
*Assistant Examiner*—Mitra Aryanpour
*Attorney, Agent, or Firm*—Price, Heneveld, Cooper, DeWitt & Litton

[57] ABSTRACT

A billiard table corner construction and method of assembly comprising a table leg having an upper portion with first and second horizontal openings perpendicular to each other, a first sill subassembly including a second horizontal opening therethrough aligned with the table leg second opening, a second sill subassembly normal to the first sill subassembly including a second horizontal opening therethrough aligned with the table leg second opening, a first rod extending through the first horizontal opening in the first sill subassembly and the first opening in the upper portion of the leg sufficiently to intersect the second opening in the leg, the first rod having an inner end, an outer end, and a transverse threaded opening therein adjacent the inner end, a second elongated threaded fastener extending through the second sill subassembly and leg, and aligned with and engaging the threaded transverse opening of the first rod for threaded connection thereto such that the second sill is forced tightly against the leg, and a first elongated threaded fastener engaged with the first rod and with the first sill subassembly to force the first sill subassembly tightly against the leg.

20 Claims, 5 Drawing Sheets

BILLIARD TABLE CORNER CONSTRUCTION

CROSS-REFERENCE TO RELATED APPLICATIONS

This application claims priority under 35 U.S.C. §119(e) on United States Provisional Application No. 60/082,799, entitled BILLIARD TABLE CORNER CONSTRUCTION AND SIGHT MARKERS, filed Apr. 23, 1998, by William R. McCormick, the entire disclosure of which is incorporated herein by reference.

BACKGROUND OF THE INVENTION

This invention relates to game tables and particularly to what is commonly referred to as billiard tables, whether including pockets and used for playing pool, or without pockets and used for playing billiards, snooker, or the like.

A billiard table typically has a set of four legs at the four corners, or two pairs of end supports each extending between two corners, a slate bed, a set of four sills supporting the slate bed along its four edges, i.e., two sills at opposite ends and two sills at opposite sides, a peripheral rail composed of two opposite side rails and two opposite end rails, and a peripheral apron depending from the rails and composed of a pair of opposite end aprons and a pair of opposite side aprons.

A common technique for interconnecting the sills to the corner legs is with interconnecting wood dowels and exterior L-shaped brackets and screws. This construction is complex and involves two holes bored into the ends of each sill and like holes bored into the leg, all to receive wood dowels; two holes drilled into the back of each sill and filled with threaded inserts; two holes drilled into the leg and filled with threaded inserts; and metal L-shaped brackets affixed to these inserts with screws. Great care must be taken to cause the doweled corner components to be pressed tightly together with no remaining gap between the sills and corner legs and then fastening the L-shaped brackets to hopefully restrain the components from separating. Unfortunately, even after all of this, prevention of separation is not always successful.

SUMMARY OF THE INVENTION

The present invention provides a unique billiard table corner construction.

Each corner of the novel table employs a pair of cooperative elongated metal rods, the first of which extends through a cleat secured to a first sill and into a corner leg, and the second of which is hollow and extends through a second cleat secured to the adjacent second sill and into the leg to intersect the first rod, so that both the two sills and the two rods are perpendicular to each other. An elongated bolt is extended through the hollow second rod and into threaded engagement with a tapped transverse hole in the first rod, to draw the second sill tightly to the leg. A smaller bolt is threaded into the first rod to draw the first sill tightly to the leg. The result is a unique, easily installed, remarkably secure and tight assembly. An object of the invention, therefore, is to provide such a corner construction and method which assures tight assembly and which eliminates the need for wood dowels and L-shaped brackets.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
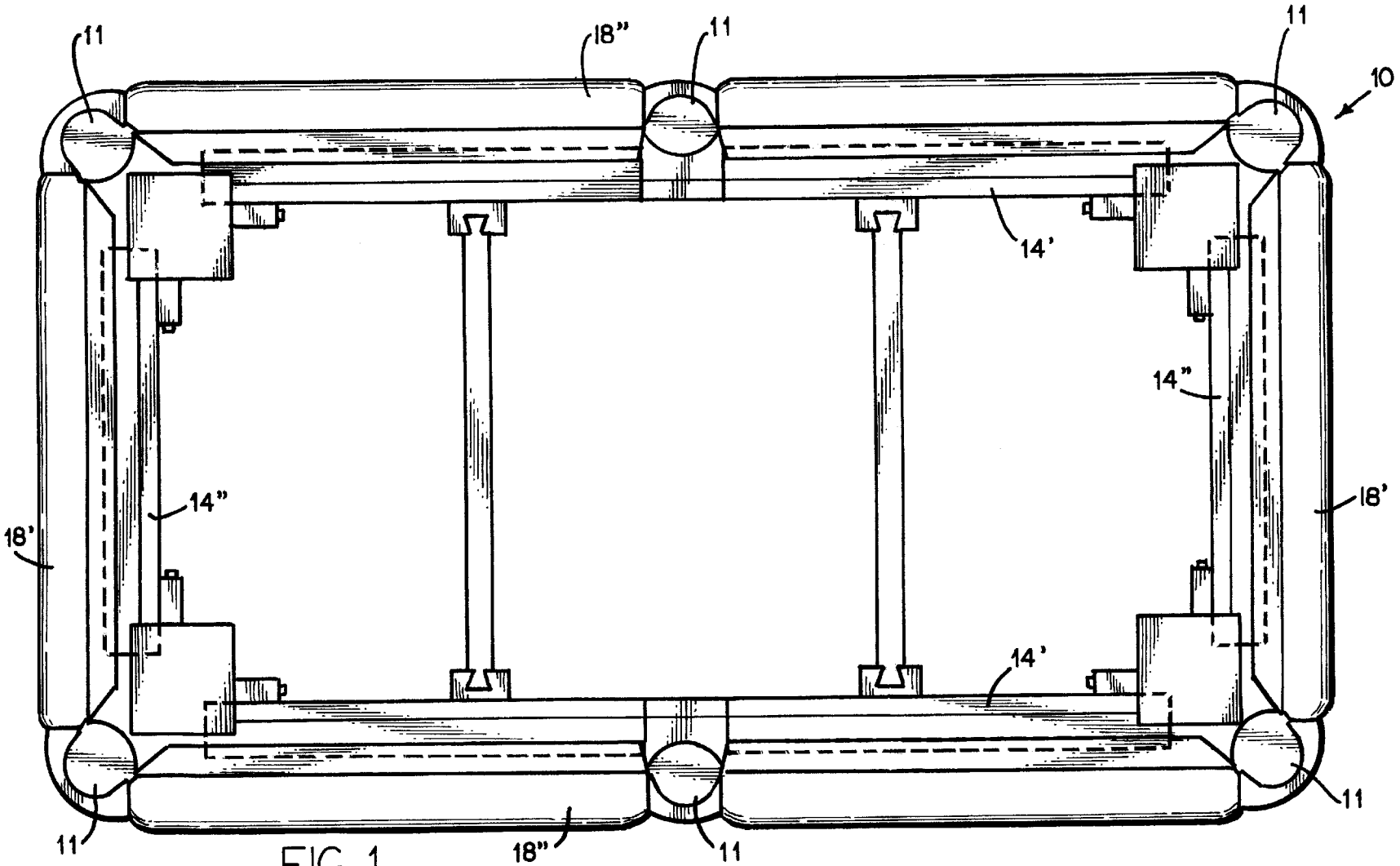
FIG. 1 is a plan view of a billiard table of the invention.

Referring now to FIGS. 1–4, the pool table 10 there depicted is shown to include four legs 12 having a lower portion of desired configuration and an upper portion 12' of rectangular, preferably square, cross-sectional configuration. On top of these legs is a peripheral sill subassembly 14 composed of a pair of opposite side sills 14' and a pair of opposite end sills 14". Resting upon and mounted to the side sills 14' and the end sills 14 is a rectangular slate bed 16. Around the periphery of slate bed 16, and mounted thereto, is a generally conventional rail and apron subassembly 18. More specifically, there are a pair of opposite end rails 18' and a pair of opposite side rails 18". A conventional rubber bumper 19 is attached to the inside of the rails. There are also a pair of opposite end aprons 20' and a pair of opposite side aprons 20". These are of conventional rail and apron types. The table is shown to include six conventional ball-receiving pockets 11 at the four corners and in the centers of the side rails.

Figure 2:
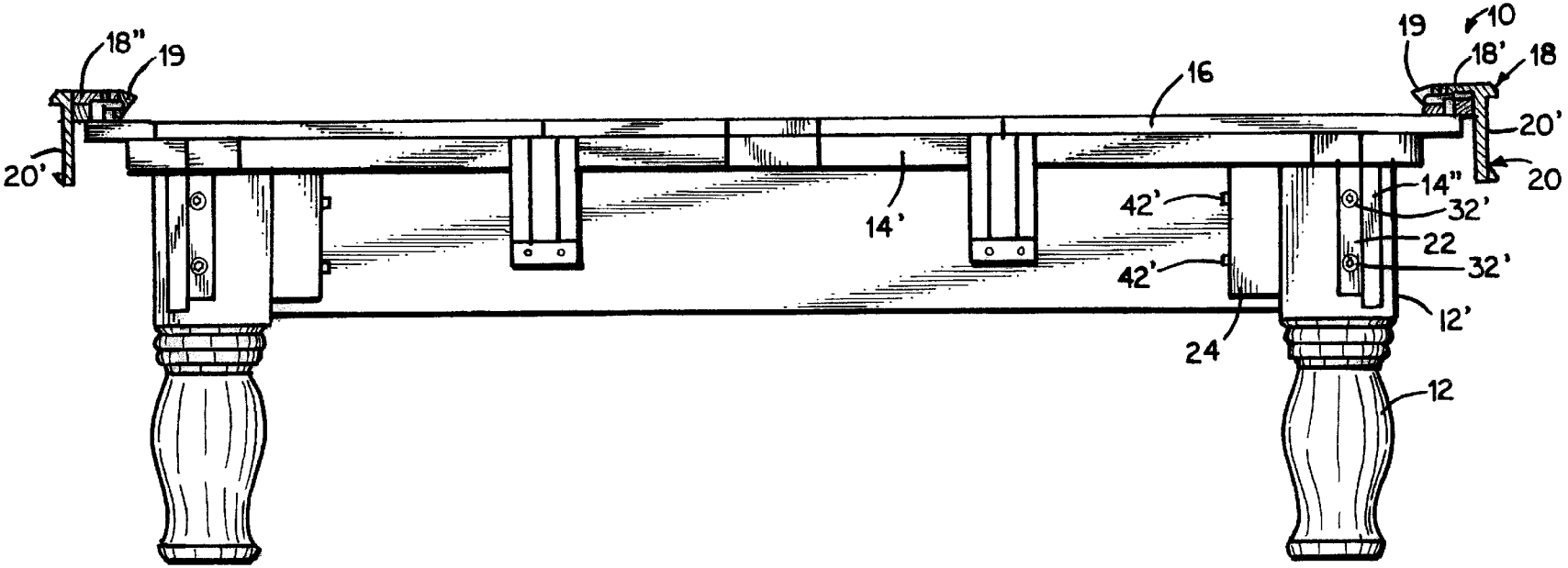
FIG. 2 is a side elevational view of the billiard table in FIG. 1, with the near side legs and near side rail and apron removed for optimum viewing of the corner construction.
Figure 3:
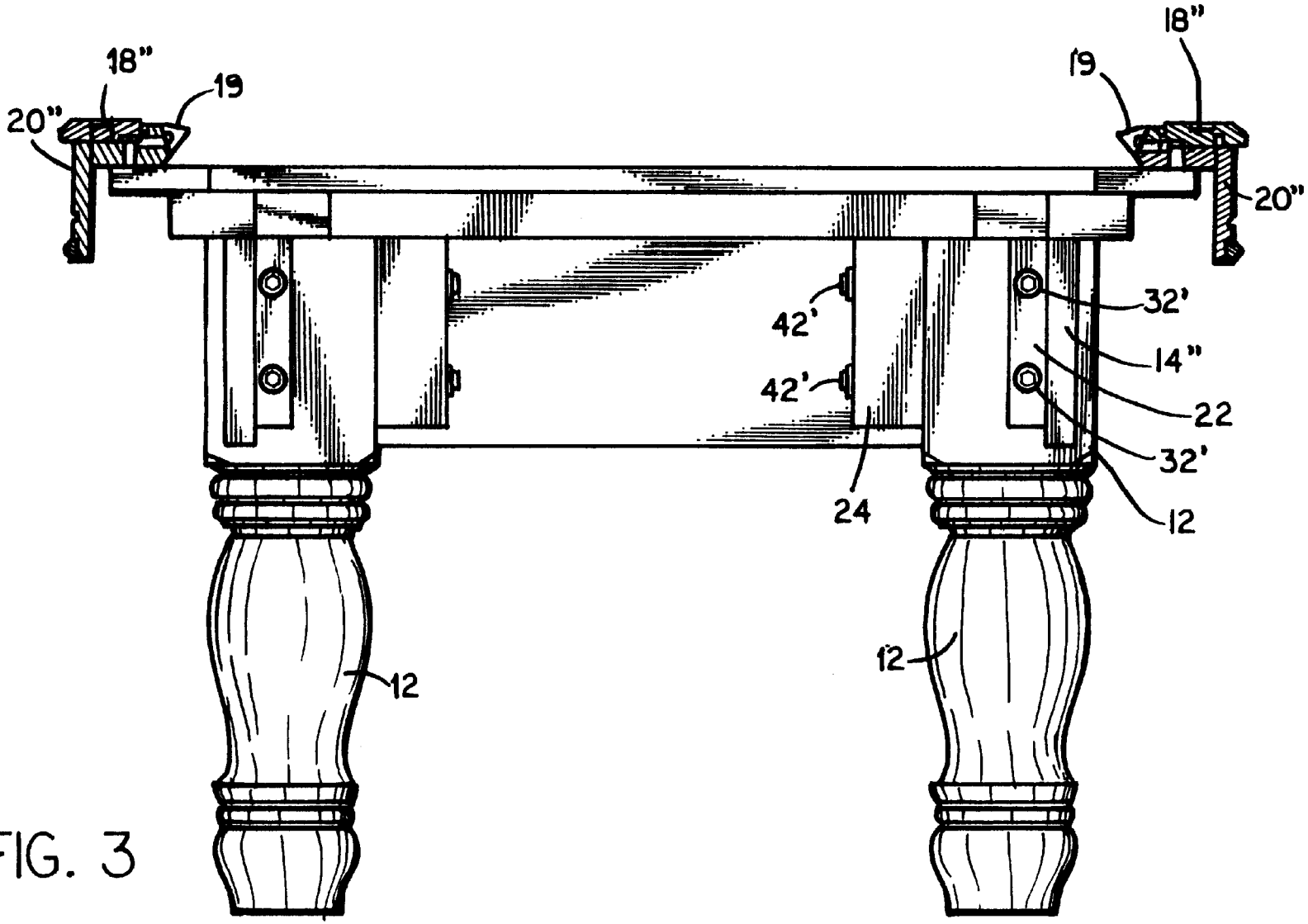
FIG. 3 is an end elevational view of the billiard table, with the near end legs and the near end rail and apron removed.
Figure 4:
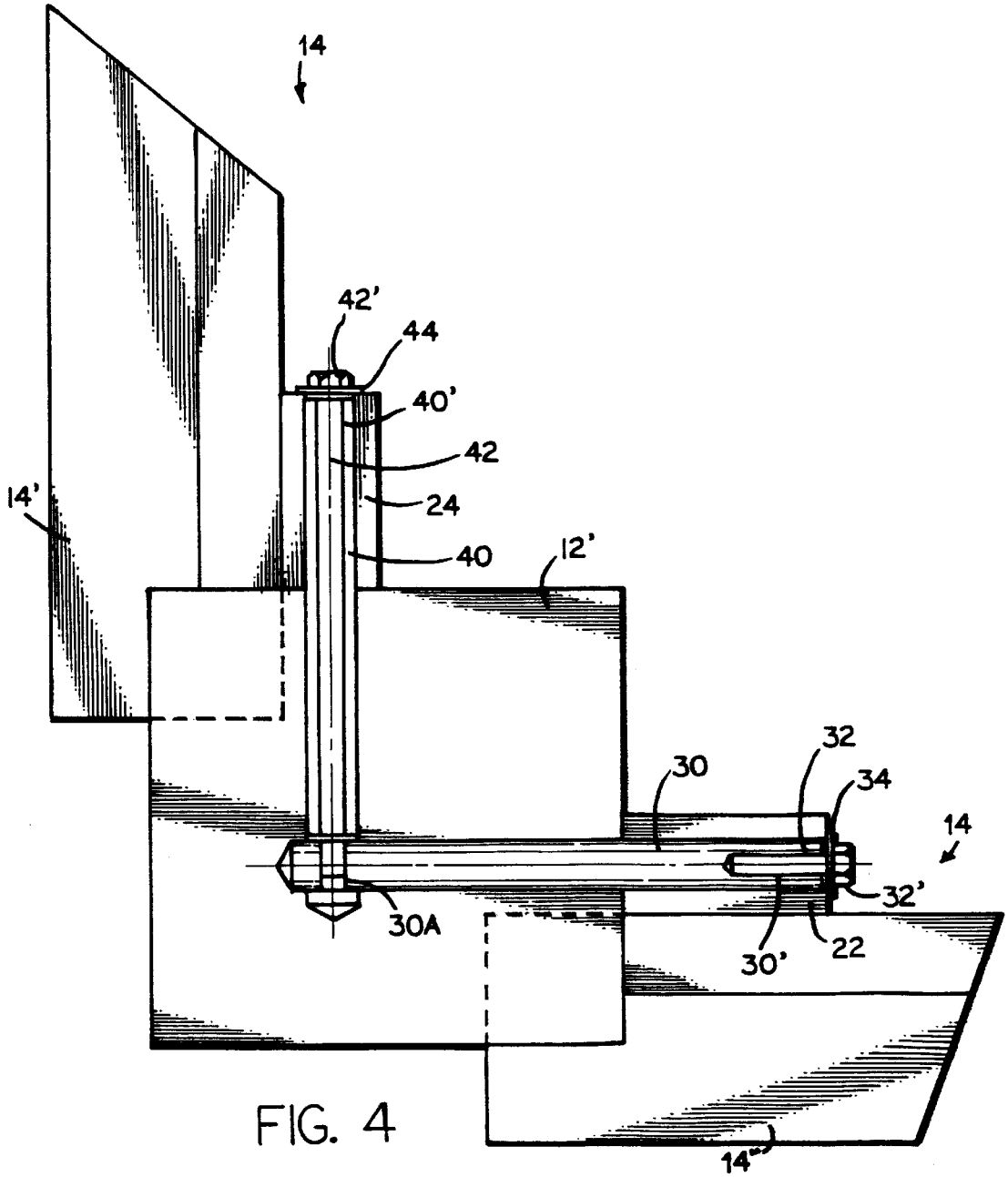
FIG. 4 is a greatly enlarged plan view of one corner of the billiard table utilizing the novel corner construction.

At each corner of the assembly are a plurality, here shown to be two, of interconnected special bolt and rod assemblies, one of which is depicted in more detail in FIG. 4. Referring to FIG. 4, end sill 14" is shown in its laterally perpendicular orientation to side sill 14'. Secured to end sill 14" is a vertically oriented wood cleat 22 having elongated horizontal openings therethrough. This securement would typically be made by gluing and screwing the cleat to the sill. Cleat 22 is vertically elongated, as seen in FIG. 2, to be secured to the vertical sill 14". Extending through cleat 22, and specifically through cylindrical openings therein, are a pair of first rods 30. The rods also extend into a cylindrical opening in upper portion 12' of leg 12 sufficiently to intersect a second cylindrical opening formed in leg portion 12' perpendicular to rod 30. A second elongated rod 40, hollow from end to end, extends through a wooden cleat 24 secured to side sill 14' as by being glued and screwed to the vertical sill plate. This rod 40 extends through cleat 24 and sufficiently through leg portion 12' to cause the inner end of rod 40 to abut the periphery of rod 30, so as to be perpendicular to it. The elongated opening 40' through rod 40 aligns with a threaded opening **30*a* extending through rod 30 transversely to the center line of rod 30 and near its inner end. An elongated bolt 42 extends through rod 40 with its threaded inner end engaging in threaded opening 30*a* of rod 30 until the head 42' of bolt 42, and preferably a washer 44, tightly engage the end of cleat 24 to force sill 14' tightly against one flat face of portion 12' of leg 12. A short bolt 32 having a hexagonal head 32' threadably engages in a threaded axial recess 30' of rod 30. This bolt, preferably with a washer 34, when tightened, presses against cleat 22 to force sill 14' tightly against another flat face of portion 12' of leg 12**.

Figure 5:
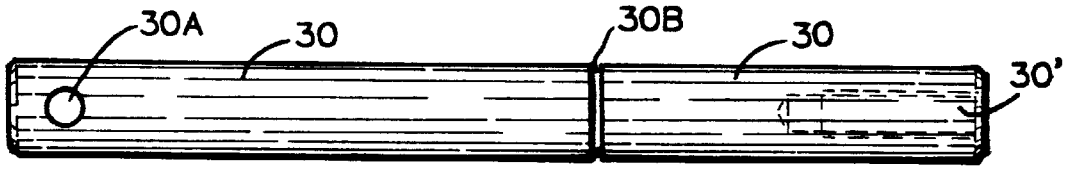
FIG. 5 is an elevational view of the first elongated rod of the corner construction.
Figure 6:
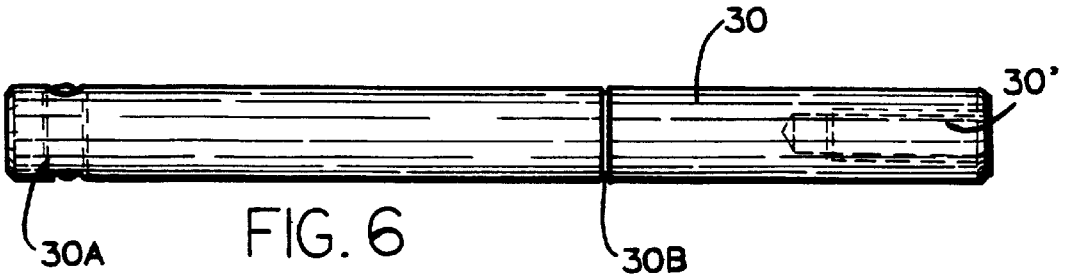
FIG. 6 is a plan view of the rod in FIG. 5.
Figure 7:
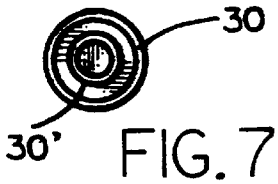
FIG. 7 is an end view of the rod in FIGS. 5 and 6.
Figure 8:
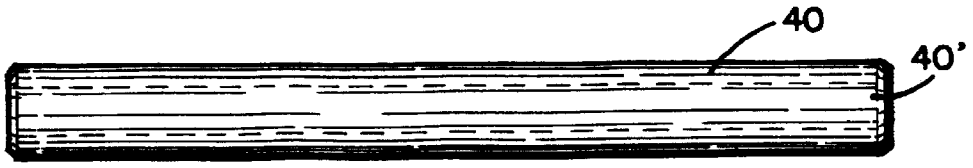
FIG. 8 is an elevational view of the second rod of the corner construction.
Figure 9:
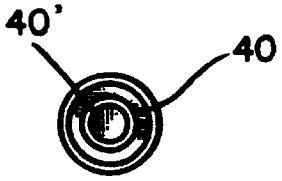
FIG. 9 is an end elevational view of the rod in FIG. 8.

The method of assembling the corner assembly comprises the steps of inserting the end of rod 30 having the transverse opening 30A into leg 12. The depth of this insertion is preferably gauged by having a witness mark 30B (FIGS. 5 and 6), such as a groove, on rod 30 for alignment with the face of leg portion 12'. Its transverse opening 30A then aligns with the other opening at 90° orientation to rod 30. Hollow rod 40 is then inserted into the other opening of leg portion 12' until it abuts against rod 30. The wood cleat 24 of side sill 14' is then placed over the exposed end of rod 40. Elongated bolt 42 with washer 44 on its head end is then inserted through hollow rod 40 and threadably engaged into the threaded transverse opening 30A of rod 30 to draw sill 14' tightly against leg 12. Thereafter, the wood cleat 22 of sill 14" is placed over the exposed end of rod 30, and shorter bolt 32 with its washer 34 is threadably inserted into the end of rod 30 and drawn tight until the washer 34 and bolt 32 forces wood cleat 22 and thus sill 14' tightly against a flat face of leg portion 12'. The tightly secured corner assembly is thus made. This preferably is repeated for two rod and bolt assemblies for the corner, and the other three corners are assembled in like fashion. Full assembly is rapid, readily done and effective in producing secure corner assemblies, yet without requiring dowels or exposed L-brackets.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A billiard table corner construction comprising:

a table leg having an upper portion with a first plurality and a second plurality of horizontal openings, said first and second plurality of openings being perpendicular to each other in said leg upper portion;

a first sill;

a second sill normal to said first sill;

a first cleat secured to said first sill, said first cleat including first horizontal openings therethrough aligned with said table leg first plurality of openings;

a second cleat secured to said second sill, said second cleat including second horizontal openings therethrough aligned with said table leg second plurality of openings;

a first plurality of rods extending through said first horizontal openings in said first cleat and into said first plurality of openings in said upper portion of said leg sufficiently to intersect said second plurality of openings in said leg;

said first plurality of rods each having inner ends, outer ends, and transverse threaded openings therein adjacent said inner ends;

a second plurality of rods extending through said second openings in said second cleat and into said second plurality of openings in said upper portion of the leg;

said second plurality of rods being axially hollow from end to end forming elongated passages;

a second plurality of elongated threaded fasteners extending through said elongated passages of said second plurality of rods and aligned with and engaging said threaded transverse openings of said first plurality of rods for threaded connection thereto such that said second cleat and said second sill are forced tightly against said leg; and a first plurality of elongated threaded fasteners engaged with said first rods and with said first cleat to force said first cleat and said first sill tightly against said leg.

2. The billiard table corner construction of claim 1 wherein said first cleat is wood.

3. The billiard table corner construction of claim 2 wherein said first cleat is secured to said first sill by adhesive and/or screws.

4. The billiard table corner construction of claim 1 wherein said second cleat is wood.

5. The billiard table corner construction of claim 4 wherein said second cleat is secured to said second sill by adhesive and/or screws.

6. The billiard table corner construction of claim 1 wherein said first rods include a threaded axial recess receiving and engaging said first plurality of threaded fasteners to force said first sill tightly against said leg.

7. The billiard table corner construction in claim 1 wherein said second plurality of rods extend into said leg sufficiently to abut said first plurality of rods.

8. The billiard table corner construction of claim 1, wherein an outside of said first plurality of rods have a transverse groove for gauging a preferred depth of the first plurality of rods in the table leg.

9. A billiard table corner construction comprising:

a table leg having an upper portion with first and second horizontal openings, said first and second openings being perpendicular to each other in said leg upper portion;

a first sill subassembly including a second horizontal opening therethrough aligned with said table leg first opening;

a first sill subassembly normal to said first sill subassembly including a second horizontal opening therethrough aligned with said table leg second opening;

a first rod extending through said first horizontal opening in said first sill subassembly into said first opening in said upper portion of said leg sufficiently to intersect said second opening in said leg;

said first rod having an inner end, an outer end, and a transverse threaded opening therein adjacent said inner end;

a second elongated threaded fastener extending through said second sill subassembly and said leg, and aligned with and engaging said threaded transverse opening of said first rod for threaded connection thereto such that said second sill is forced tightly against said leg; and a first elongated threaded fastener engaged with said first rod and with said first sill subassembly to force said first sill subassembly tightly against said leg.

10. The billiard table corner construction of claim 9 wherein said first rod includes a threaded axial recess receiving and engaging said first threaded fastener to force said first sill subassembly tightly against said leg.

11. The billiard table corner construction of claim 9 wherein said first sill subassembly comprises a first sill and a first cleat.

12. The billiard table corner construction of claim 11 wherein said second sill subassembly comprises a second sill and a second cleat.

13. The billiard table corner construction of claim 9 including a second, axially hollow rod extending through said second sill subassembly and said leg to said first rod, and said second elongated fastener extends through said second rod.

14. The billiard table corner construction of claim 9, wherein an outside of said first rod has a transverse groove for gauging a preferred depth of the rods in the table leg.

15. The method of assembling a billiard table corner leg assembly comprising the steps of:

a) providing a leg having in the upper portion thereof a first plurality and a second plurality of horizontal openings, normal to each other;

b) providing first and second sills having respective first and second cleats, said first and second cleats having respective first and second pluralities of openings;

c) aligning said first and second pluralities of cleat openings with said first and second pluralities of leg openings, respectively;

d) providing a first plurality of rods having inner ends, outer ends, transverse threaded openings adjacent said inner ends and axial threaded openings at said outer ends;

e) providing a second plurality of rods hollow from end to end;

f) inserting said first plurality of rods into said first plurality of cleat openings and said first plurality of leg openings such that said transverse openings align with said second plurality of leg openings;

g) inserting said hollow rods into said second plurality of cleat openings and said second plurality of leg openings until they abut against said first plurality of rods;

h) inserting elongated bolts through said hollow rods and threadably engaging said threaded transverse openings of the first rods to draw said second cleat tightly against said leg; and i) inserting bolts threadably into said axial threaded openings to force said first cleat tightly against said leg.

16. The method of assembling a billiard table corner leg assembly of claim 15, further comprising providing a transverse groove on an outside of said first plurality of rods, and wherein said step of inserting said first plurality of rods further comprises inserting said first plurality of rods into the first plurality of leg openings until the transverse groove aligns with a face of the leg.

17. The method of assembling a billiard table corner leg assembly comprising the steps of:

a) providing a leg having in the upper portion thereof first and second horizontal openings, normal to each other;

b) providing first and second sill subassemblies having respective first and second horizontal openings;

c) aligning said first and second sill subassembly openings with said first and second leg openings, respectively;

d) providing a first rod having an inner end, an outer end, and a transverse threaded opening adjacent said inner end, and an axial threaded opening at said outer end;

e) inserting said first rod into said first sill subassembly opening and said first leg opening such that said transverse opening aligns with said second leg opening;

f) inserting an elongated bolt through said second sill subassembly opening and said second leg opening and threadably engaging said threaded transverse opening of the first rod to draw said second sill subassembly tightly against said leg; and g) inserting a bolt threadably into said axial threaded opening to force said first sill subassembly tightly against said leg.

18. The method of assembling a billiard table corner leg in claim 17 including the steps of:

h) providing a second rod, hollow from end to end; and i) inserting said hollow rod into said second sill subassembly opening and said second table leg opening, and said elongated bolt in step f) being inserted through said hollow rod.

19. The method of assembling a billiard table corner leg in claim 18 wherein said hollow rod is abutted against said first rod.

20. The method of assembling a billiard table corner leg assembly of claim 17, further comprising providing a transverse groove on an outside of said first rod, and wherein said step of inserting said first rod further comprises inserting said rod into the first opening until the transverse groove aligns with a face of the leg.

* * * * *